US005386352A

United States Patent [19]

Chu

[11] Patent Number: 5,386,352

[45] Date of Patent: Jan. 31, 1995

[54] FLASHLIGHT

[76] Inventor: An G. Chu, P.O. Box 82-144, Taipei, Taiwan, Prov. of China

[21] Appl. No.: 87,529

[22] Filed: Jul. 8, 1993

[51] Int. Cl.[6] ..... F21L 7/00

[52] U.S. Cl. ..... 362/206; 362/202; 362/205

[58] Field of Search ..... 362/158, 194, 195, 202, 362/203, 205, 206, 208, 204; 200/60

[56] References Cited

U.S. PATENT DOCUMENTS

| | | | |
|---|---|---|---|
| 1,265,820 | 5/1918 | Seymour | 362/206 |
| 2,268,878 | 1/1942 | Kopp | 362/208 |
| 4,733,337 | 3/1988 | Bieberstein | 362/202 |
| 5,006,969 | 4/1991 | Lai | 362/206 |
| 5,091,611 | 2/1992 | Raevas et al. | 362/208 |
| 5,158,358 | 10/1992 | Maglica et al. | 362/203 |
| 5,161,095 | 11/1992 | Gammache | 362/206 |

FOREIGN PATENT DOCUMENTS

| | | | |
|---|---|---|---|
| 1035949 | 9/1953 | France | 362/206 |
| 397758 | 8/1933 | Germany | 362/206 |
| 342342 | 1/1931 | United Kingdom | 362/205 |
| 2227825 | 8/1990 | United Kingdom | 362/202 |

*Primary Examiner*—Ira S. Lazarus
*Assistant Examiner*—Y. Quach
*Attorney, Agent, or Firm*—Alfred Lei

[57] ABSTRACT

This invention relates to a flashlight and in particular to one including, a tubular barrel with internal threads at one end and external threads at another end, a packing ring fitted with the end of the tubular barrel with external threads, a head threadedly engaged with the end of the tubular barrel with external threads, a socket fitted in the head, a light bulb fitted in the socket, a reflector mounted on the socket, a piece of glass disposed on the reflector, and a switch assembly including a switch having a center threaded hole, two packing rings, a tail seat threadedly engaged with the end of the tubular barrel with internal threads and having a hexagonal recess, a hexagonal nut fitted in the hexagonal recess, and a screw having a first threaded portion engaged with the hexagonal nut and a second threaded portion engaged with a center threaded hole of the switch, whereby the flashlight may be switched on or off simply by turning the switch at its tail end.

1 Claim, 4 Drawing Sheets

FLASHLIGHT

BACKGROUND OF THE INVENTION

It has been found that the switch of the conventional flashlight on the market is mounted on the neck portion thereof. However, the structure of such switch is easily damaged and should be improved. Hence, various kinds of switch for flashlights have been developed, but none of them are satisfactory in use.

Therefore, it is an object of the present invention to provide a flashlight which may obviate and mitigate the above-mentioned drawbacks.

SUMMARY OF THE INVENTION

This invention relates to an improved flashlight.

It is the primary object of the present invention to provide a flashlight which is provided with a switch at its tail end.

It is another object of the present invention to provide a flashlight which is easy to operate.

It is still another object of the present invention to provide a flashlight which is simple in construction.

It is still another object of the present invention to provide a flashlight which is economic to produce.

It is a further object of the present invention to provide a flashlight which is water-proof.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
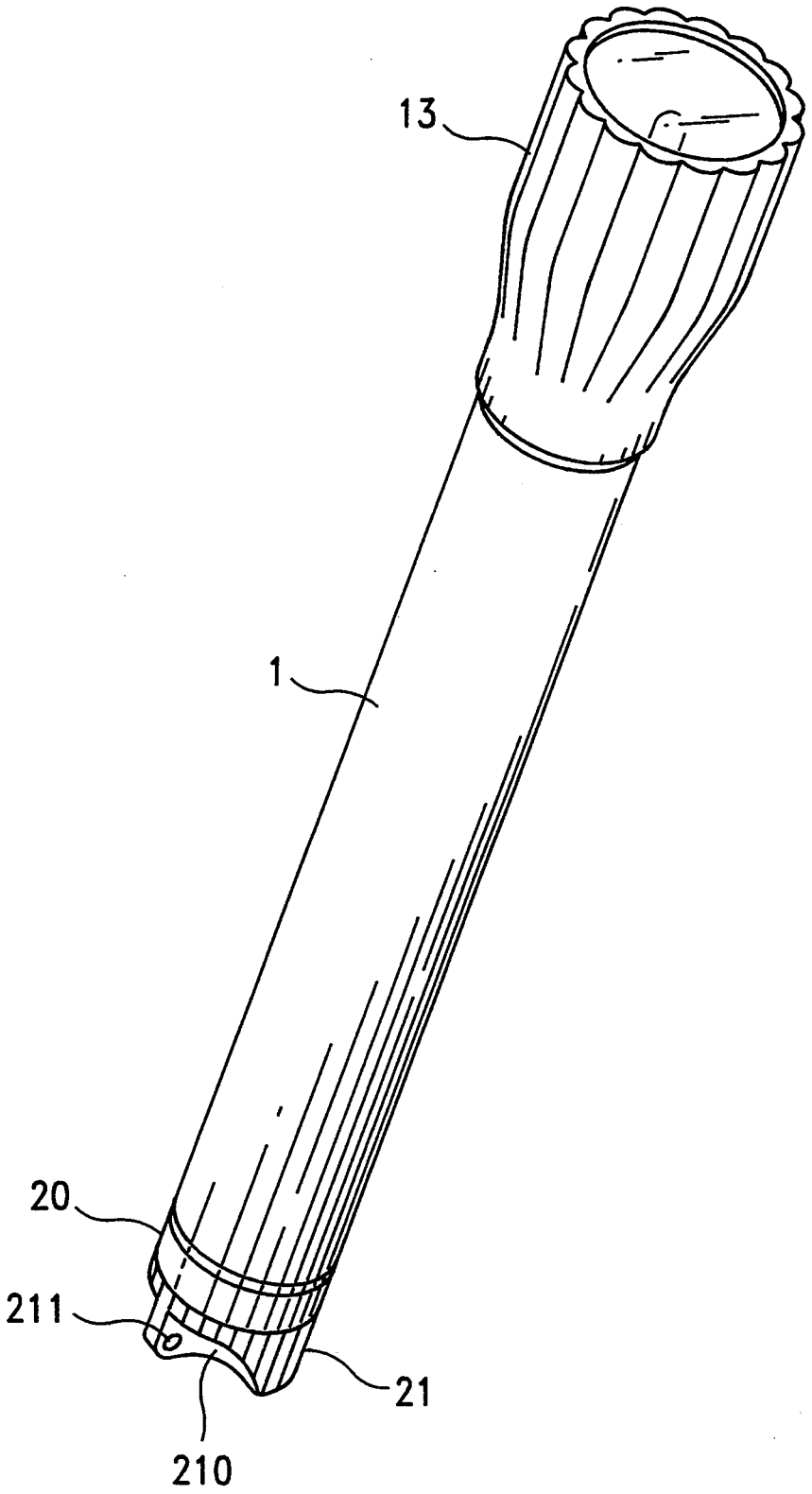
FIG. 1 is a perspective view of a flashlight according to the present invention.

For the purpose of promoting an understanding of the principles of the invention, reference will now be made to embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
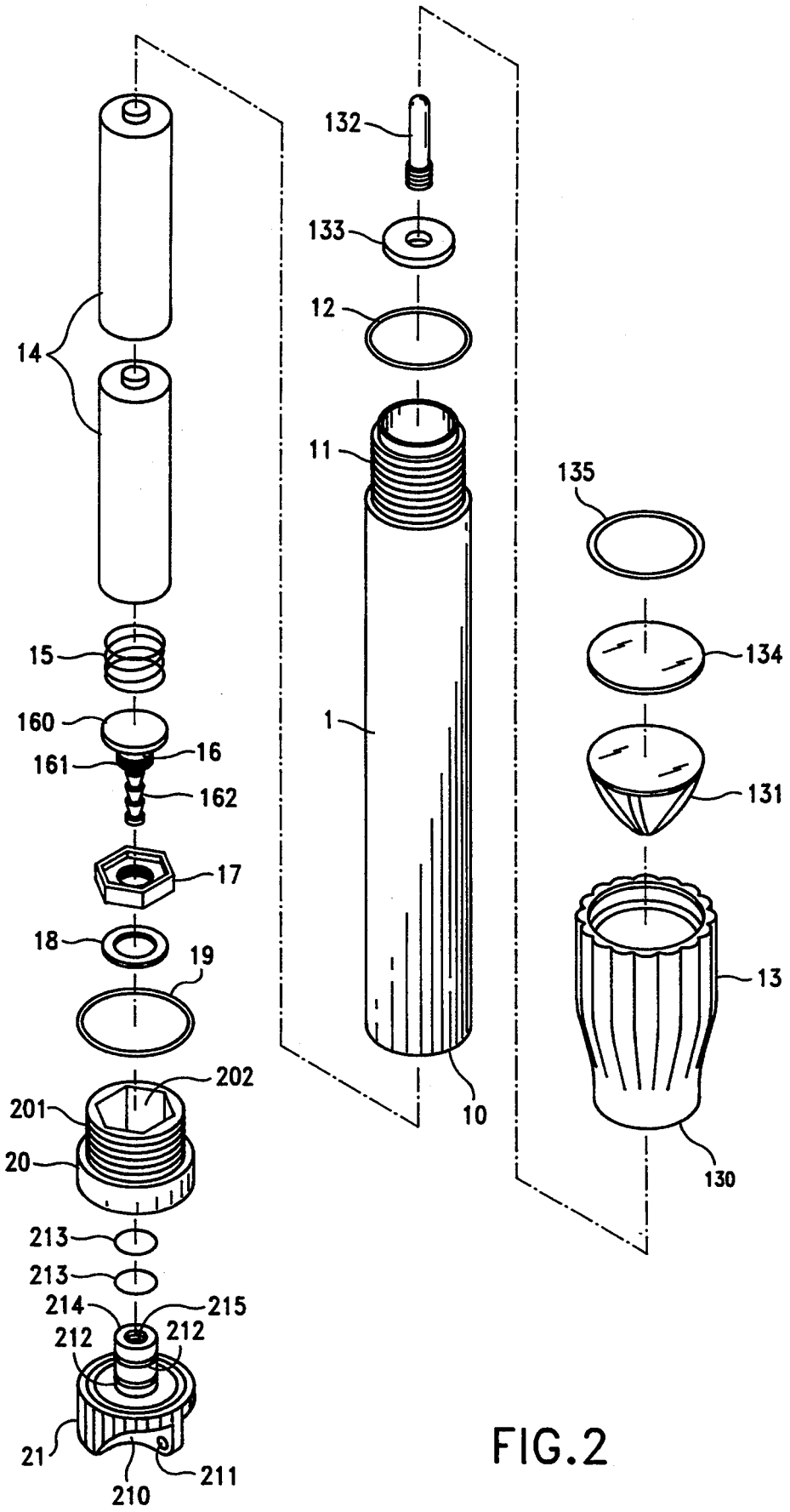
FIG. 2 is an exploded view of the flashlight.

With reference to the drawings and in particular to FIGS. 1 and 2 thereof, the flashlight according to the present invention comprises a tubular barrel 1 with internal threads 10 at one end and external threads 11 at another end. A packing ring 12 is fitted with the end of the tubular barrel 1 with external threads 11. The external threads 11 of the tubular barrel 1 is engaged with internal threads 130 of a head 13. A socket 133 together with a light bulb 132 is fitted in the head 13. Further, above the light bulb, there are mounted a reflector 131, a piece of glass 134 and a packing ring 135. Two batteries 14 are received in the tubular barrel 1. Under the batteries 14 there is a spring 15 and a switch assembly.

Figure 3:
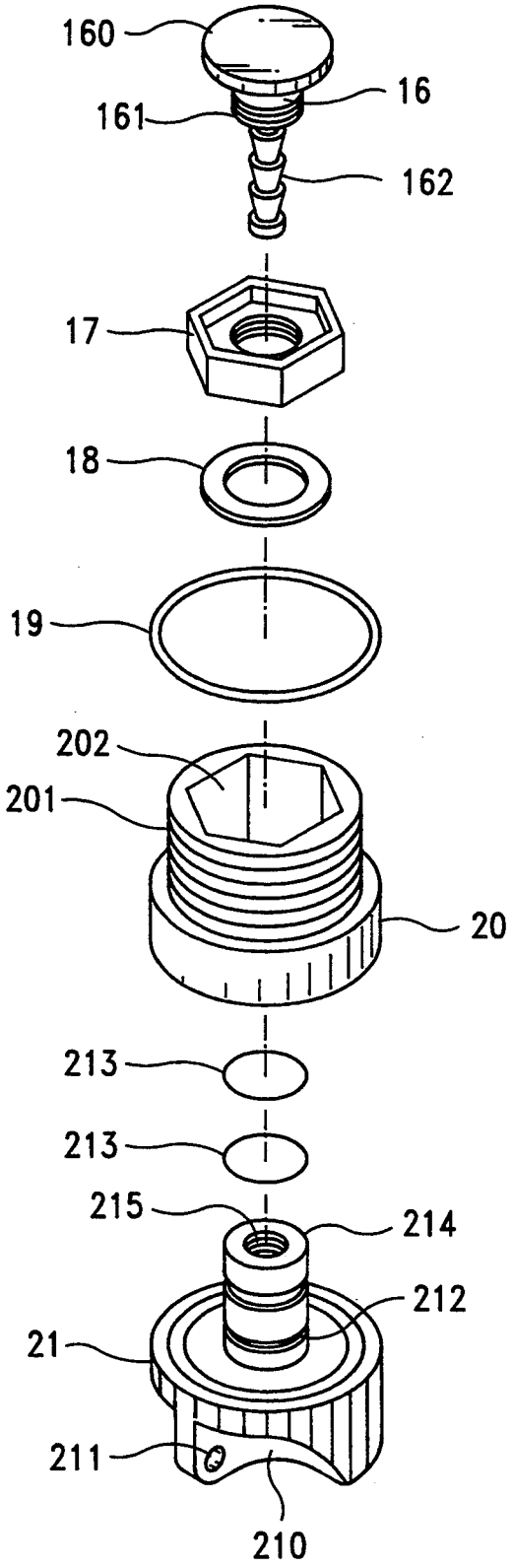
FIG. 3 is an exploded view of the switch assembly.
Figure 4:
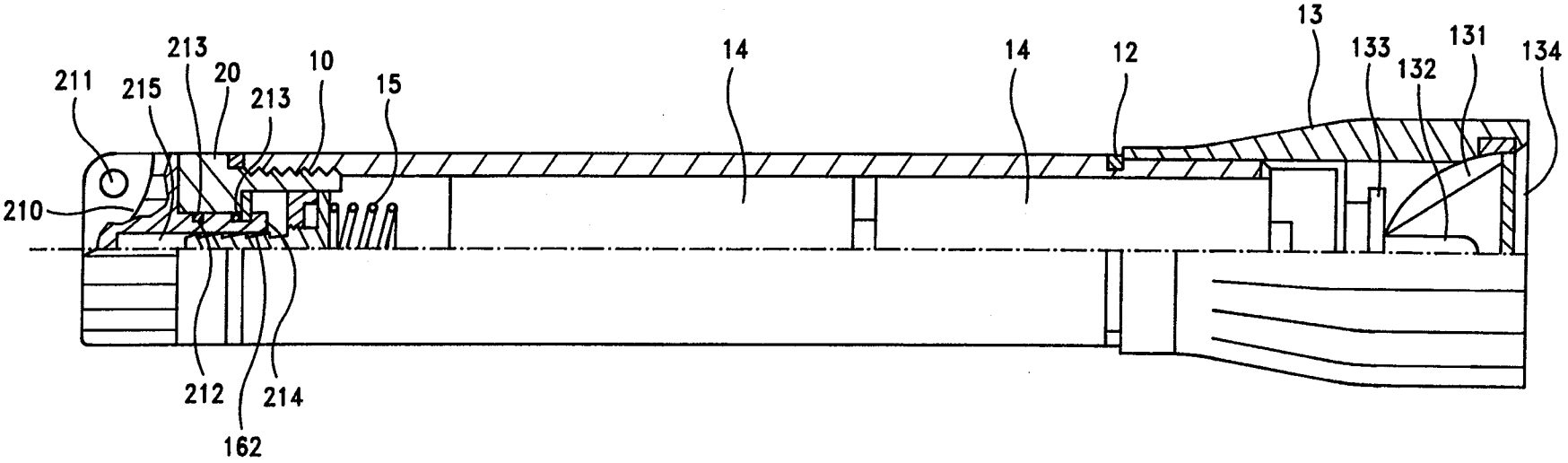
FIG. 4 is a sectional view of the flashlight.

Turning to FIG. 3, the switch assembly includes a switch 21, two packing ring 213, a tall seat 20, a packing ring 19, a washer 18, a hexagonal nut 17 and a screw 16. The switch 21 is provided with a web 210 on which there is a hole 211 for connecting a key ring (not shown). In addition, the switch 21 is formed with a projection 214 having a center threaded hole 215 and two grooves 212 for receiving the two packing rings 213. The tail seat 20 is provided with external threads 201 and connected with a packing ring 19. Further, the tall seat 20 has a hexagonal recess 202 on which is mounted a washer 18. A hexagonal member 17 is disposed within the hexagonal recess 202 of the tail seat 20. A screw 16 having a stop plate 160, a first threaded portion 161 and a second threaded portion 162 is threadedly engaged with the hexagonal member 17. Meanwhile, the second threaded portion 162 of the screw 16 will engage with the threaded hole 215 of the switch 21. The threads 201 of the tail seat 20 are engaged with the internal threads 10 of the tubular barrel 1.

As illustrated, when the switch 21 is turned in one predetermined direction, the hexagonal member 17 will be forced to go upwards thereby urging the screw 16 to press the spring 15 against the negative pole of the battery 14 and therefore, forming a closed circuit. It should be noted that the screw 16 is connected to the socket 133 by well known means which has no need to be described here in detail. As the switch 21 is turned in a reverse direction, the hexagonal member 17 will be moved downwards thereby detaching the spring from the negative pole of the battery 14 thus breaking off the circuit.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A flashlight comprising:

a tubular barrel with internal threads at one end and external threads at another end;

a packing ring fitted with said another end of said tubular barrel with external threads; a head having internal threads threadedly engaged with said external threads of said another end of said tubular barrel;

a socket fitted in said head;

a light bulb fitted in said socket;

a reflector mounted on said socket;

a piece of glass disposed on said reflector; and a switch assembly including a switch having a projection with an internal center threaded hole and two external grooves, two packing rings each received in one of said two grooves, a tall seat having external threads threadedly engaged with said internal threads of said one end of said tubular barrel and having a hexagonal recess, a hexagonal nut fitted in said hexagonal recess, and a screw having a first threaded portion engaged with the hexagonal nut and a second threaded portion engaged with a center threaded hole of said switch.

* * * * *